US005458249A

United States Patent [19]

Shang-Lu

[11] Patent Number: 5,458,249

[45] Date of Patent: Oct. 17, 1995

[54] HANGING DEVICE FOR DRYING CLOTHES

[76] Inventor: Tsai Shang-Lu, P.O. Box 82-144, Taipei City, Taiwan

[21] Appl. No.: 263,714

[22] Filed: Jun. 22, 1994

[51] Int. Cl.[6] ..... A47F 5/00

[52] U.S. Cl. ..... 211/197; 211/196; 211/86

[58] Field of Search ..... 211/86, 197, 196, 211/205; 248/159

[56] References Cited

U.S. PATENT DOCUMENTS

| | | | |
|---|---|---|---|
| 450,146 | 4/1891 | Gibford | 211/197 X |
| 843,712 | 2/1907 | Straub | 211/197 |
| 1,034,846 | 8/1912 | Thomas | 211/197 X |
| 3,424,317 | 1/1969 | Singer | 211/196 X |
| 4,101,037 | 7/1978 | Allesch et al. | 211/197 X |
| 4,847,123 | 7/1989 | Armstead et al. | 211/197 X |
| 5,094,893 | 3/1992 | Snider | 211/205 X |
| 5,318,175 | 6/1994 | Stevens | 211/196 X |

*Primary Examiner*—Robert W. Gibson, Jr.
*Attorney, Agent, or Firm*—Alfred Lei

[57] ABSTRACT

A hanging device for drying clothes including a base, a main rod vertically arranged on the base, a plurality of tubular members fixedly mounted on the main rod, a plurality of gears each fixedly connected with one of the tubular members, a plurality of sleeves each connected with one of the tubular members and having an upper flange, a plurality of cables having an end connected with the upper flange of the sleeves, a hexagonal frame connected with another end of the cables, a plurality of supporting rods pivotally connected with the gear, and a plurality of connectors each connected with a side of the hexagonal frame and one of the supporting rods.

1 Claim, 5 Drawing Sheets

HANGING DEVICE FOR DRYING CLOTHES

BACKGROUND OF THE INVENTION

It has been found that the conventional way to hang clothes is to suspend them on a string or hangers suspended from a string thereby occupying a lot of space. Further, the clothes might be blown together, making them require a long time to be dried.

Therefore, it is an object of the present invention to provide a hanging device for drying clothes which may obviate and mitigate the above-mentioned drawbacks.

SUMMARY OF THE INVENTION

This invention relates to a hanging device for drying clothes.

It is the primary object of the present invention to provide a hanging device for drying clothes which is compact in size.

It is another object of the present invention to provide a hanging device for drying clothes which is simple-in construction.

It is still another object of the present invention to provide a hanging device for drying clothes which is easy to use.

It is still another object of the present invention to provide a hanging device for drying clothes which is low in cost.

It is a further object of the present invention to provide a hanging device for drying clothes which is facile to assemble.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1A:
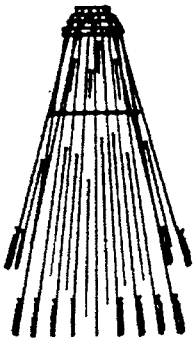
FIG. 1A shows the collapsed state of the supporting rods.
Figure 1:
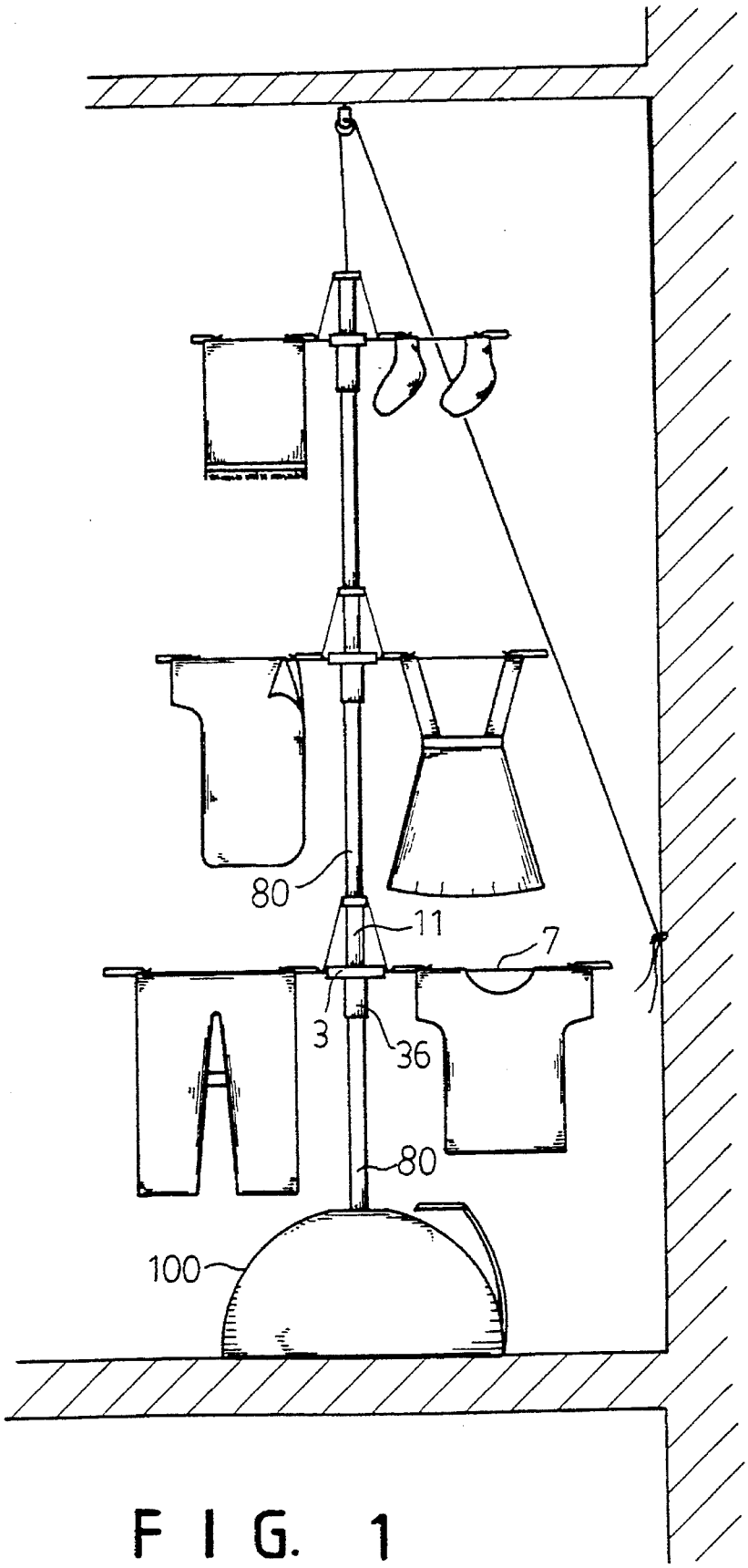
FIG. 1 is a working view of the present invention.
Figure 2:
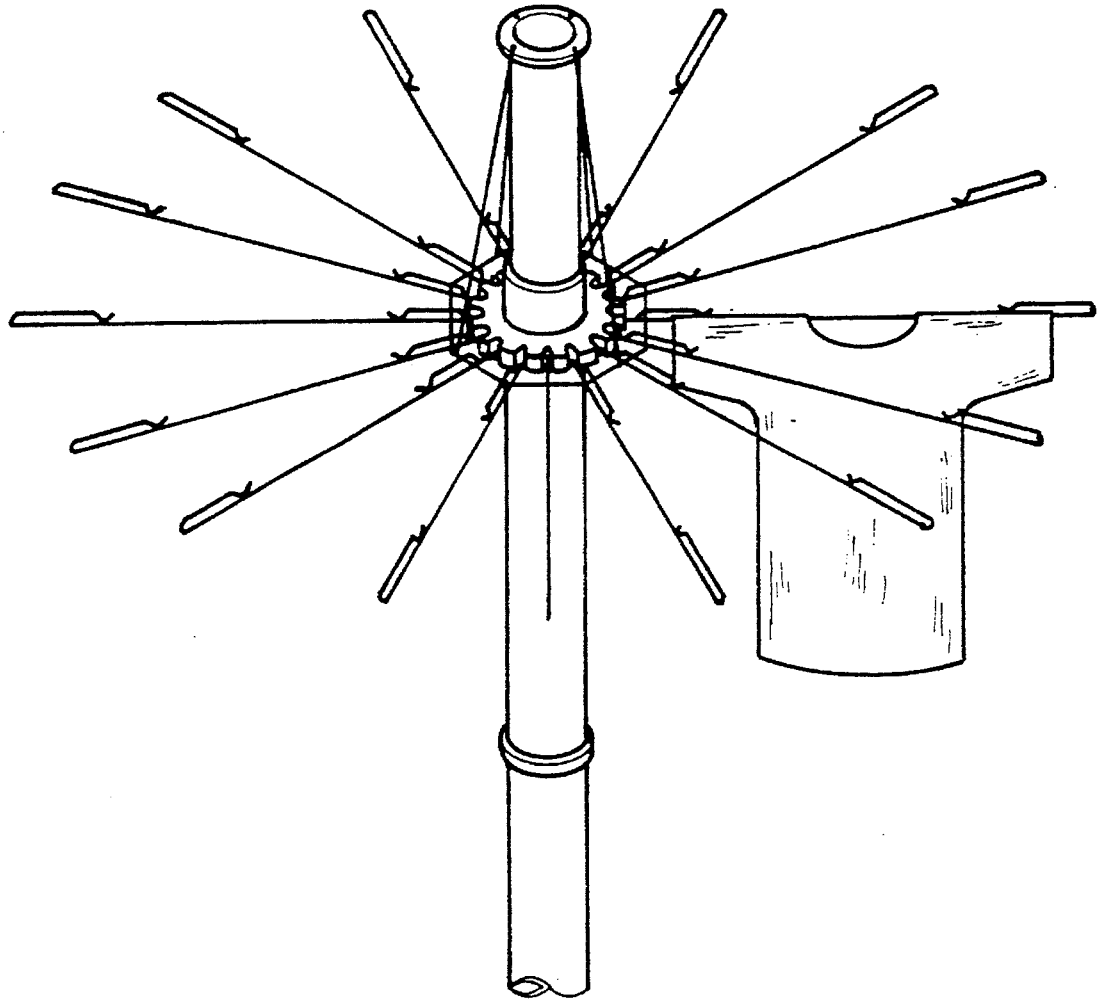
FIG. 2 shows the expanded state of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figures 3, 3A:
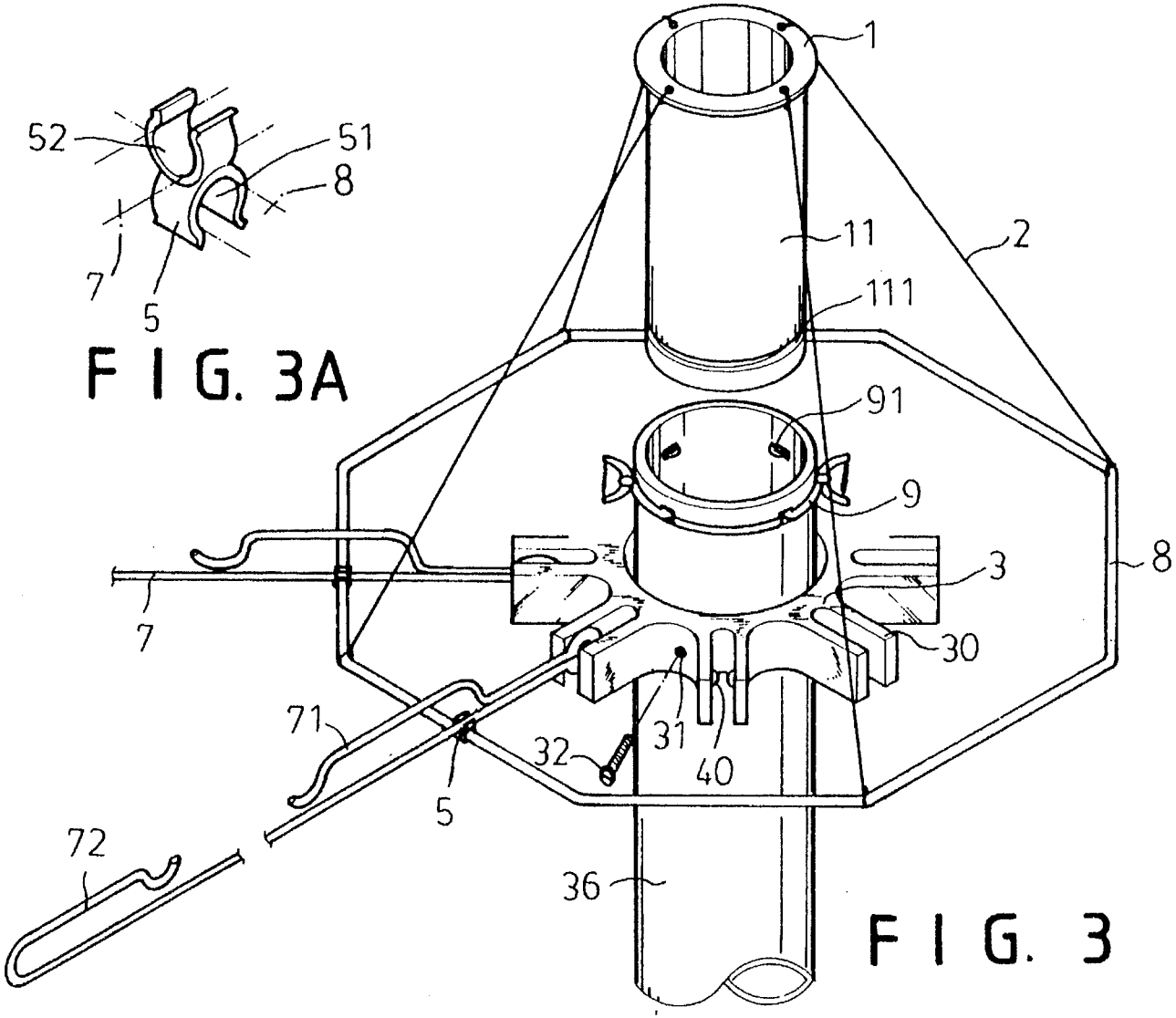
FIG. 3 an exploded view of the present invention.
Figure 4:
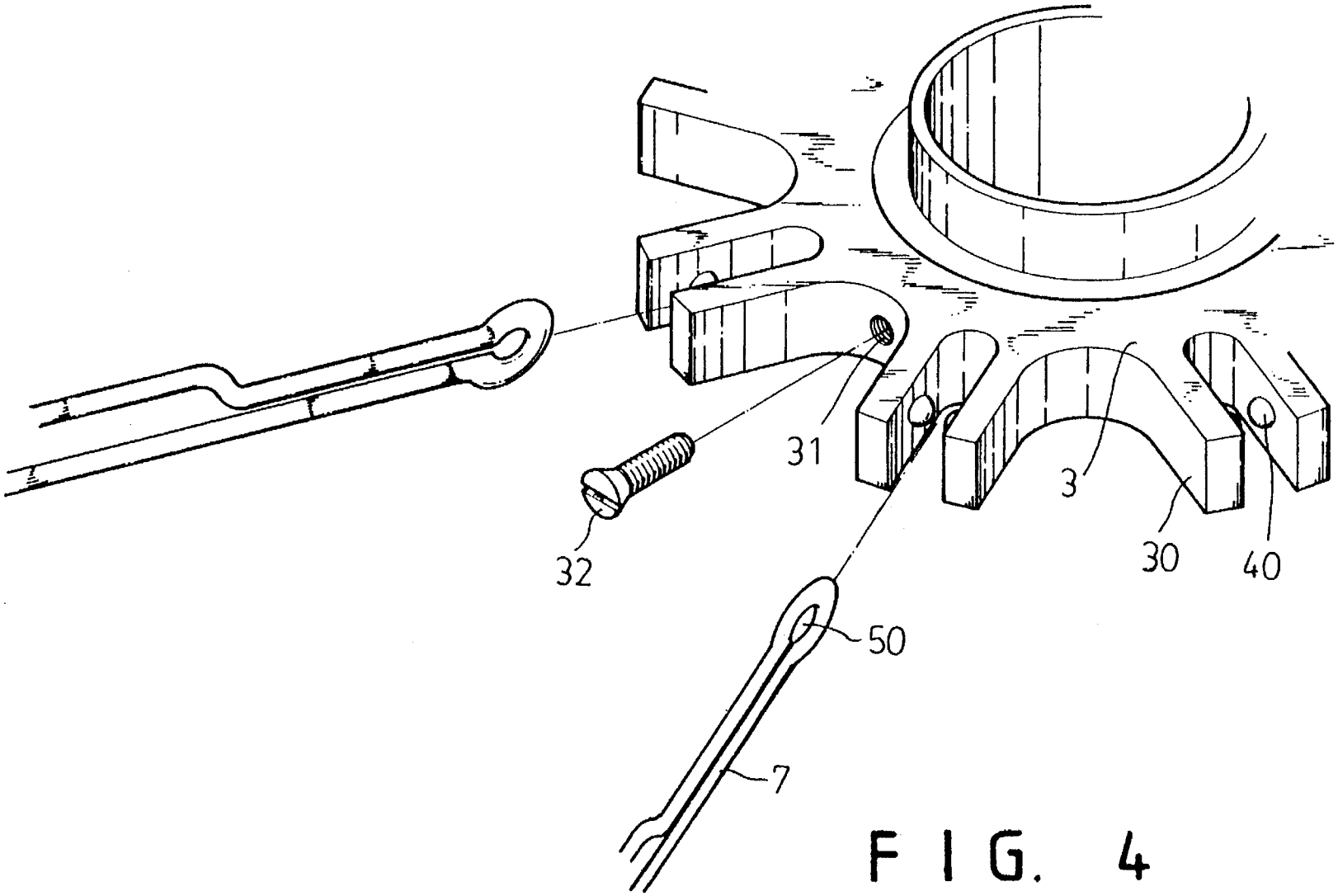
FIG. 4 is an enlarged fragmentary view of the present invention.
Figure 5:
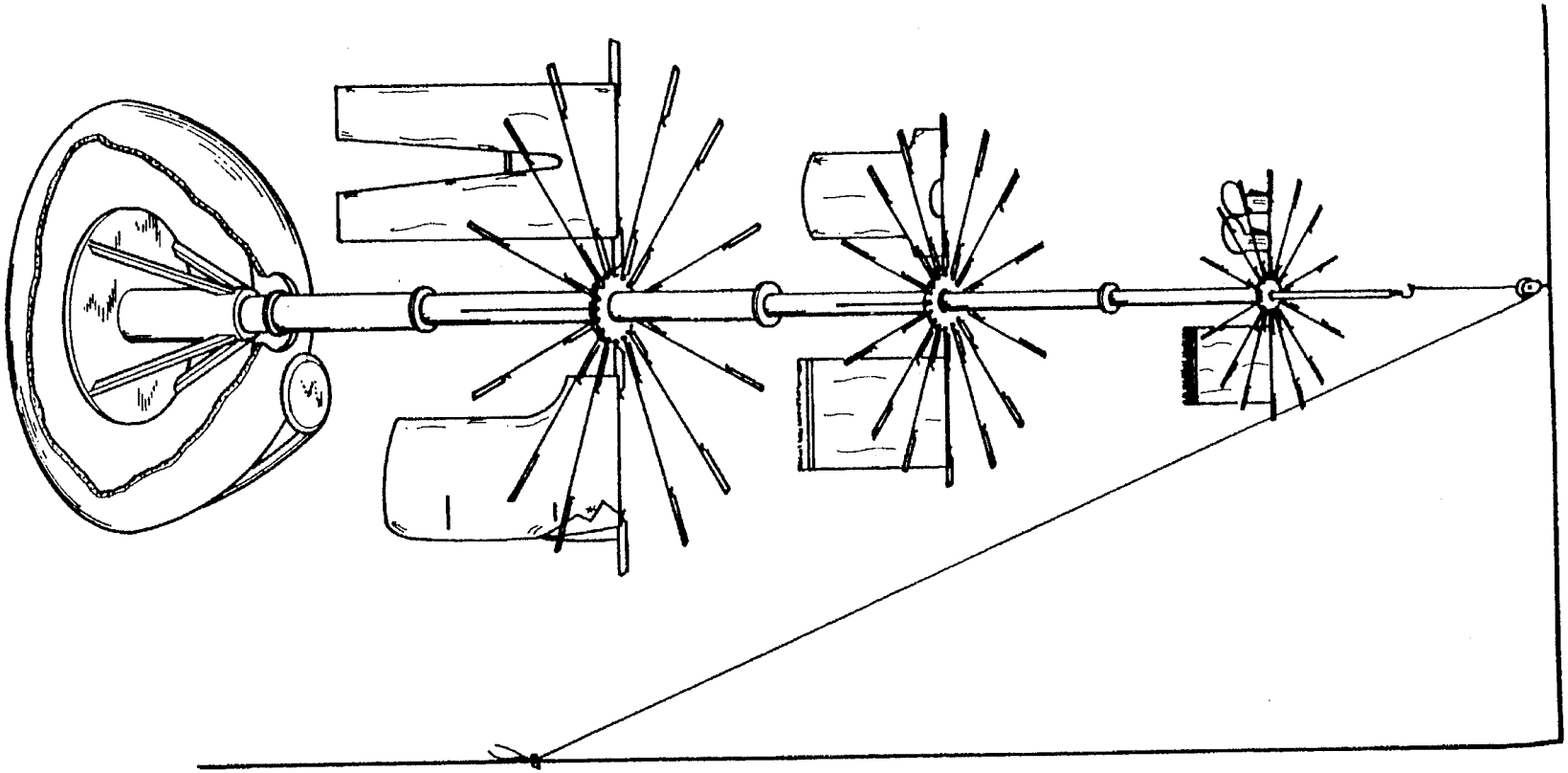
FIG. 5 shows another working view of the present invention.

With reference to the drawings and in particular to FIGS. 1, 2, 3 and 4 thereof, the hanging device for drying clothes according to the present invention comprises a base 100 and a main rod 80 vertically arranged on the base 100. On the main rod 80 are fixedly mounted a plurality of tubular members 36. A sleeve 11 formed with a flange 1 at the top and a groove 111 at the bottom is rotatably connected with the tubular member 31 and kept in place by the projections 91 of a retainer 9. The flange 1 of the sleeve 11 is connected with a plurality of cables 2 which are in turned connected with an octagonal frame 8. A gear 3 having threaded holes 31 is fixedly mounted on the tubular member 36 by screws 32. The gear 3 is formed with at least sixteen pairs of lugs 33. The inner side of each lug 33 is provided with a protuberance 4 so that an eye 50 at an end of a supporting rod 7 can be forced between two protuberances 40 of two lugs 33 thereby enabling the supporting rod 7 to be rotated with respect to the gear 3. Each side of the octagonal frame 8 is movably connected with at least two connectors 5 (only one connector 5 is shown in FIG. 3). The connector 5 is formed with a longitudinal groove 51 at the lower side and a transverse groove 52 at the upper side (see FIG. 3A). The longitudinal groove 51 of the connector 5 is movably connected with a side of the octagonal frame 4, while the transverse groove 52 is movably connected with the supporting rod 7. The supporting rod 7 is provided with an outer clip 72 and an inner clip 71 for keeping the clothes in position.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby , departing from the scope of the invention. This invention accordingly includes all the means constituting technical equivalents of the means described as well as their combinations.

I claim:

1. A hanging device for drying clothes comprising:

a base;

a main rod vertically arranged on said base;

a plurality of tubular members fixedly mounted on said main rod;

a plurality of gears each fixedly connected with one of said tubular members;

a plurality of sleeves each connected with one of said tubular members and having an upper flange;

a plurality of cables having an end connected with the upper flange of said sleeves;

a hexagonal frame connected with another end of said cables;

a plurality of supporting rods pivotally connected with said gear; and a plurality of connectors each connected with a side of said hexagonal frame and one of said supporting rods.

* * * * *